US005741160A

United States Patent [19]

Arnold

[11] Patent Number: 5,741,160

[45] Date of Patent: Apr. 21, 1998

[54] MULTIPLE PLUG ARRANGEMENT WITH A PLURALITY OF INDIVIDUAL PLUGS

[76] Inventor: Werner Arnold, Georgstrasse 13, 41363 Jüchen, Germany

[21] Appl. No.: 747,565

[22] Filed: Nov. 12, 1996

[30] Foreign Application Priority Data

Nov. 10, 1995 [DE] Germany ..... 195 41 936.7

[51] Int. Cl.[6] ..... H01R 13/502; H01R 13/514

[52] U.S. Cl. ..... 439/701

[58] Field of Search ..... 439/686, 695, 439/701

[56] References Cited

U.S. PATENT DOCUMENTS

| | | | |
|---|---|---|---|
| 4,674,814 | 6/1987 | Hoshino et al. | 439/701 |
| 4,913,667 | 4/1990 | Muz | 439/695 |
| 5,281,161 | 1/1994 | Kanai | 439/701 |
| 5,415,566 | 5/1995 | Brunker et al. | 439/701 |

FOREIGN PATENT DOCUMENTS

| | | | |
|---|---|---|---|
| 3012174C2 | 10/1981 | Germany | H01R 13/46 |
| 3012174 | 11/1984 | Germany . | |
| 3807645A1 | 9/1989 | Germany | H01R 13/46 |

*Primary Examiner*—Gary F. Paumen
*Assistant Examiner*—Katrina Davis
*Attorney, Agent, or Firm*—Whitham, Curtis, Whitham & McGinn

[57] ABSTRACT

A multiple plug arrangement with a plurality of individual plugs with essentially rectangular plug housings and with a holder that receives the plug housings arranged side by side and flush, the holder being closable on its top by a lid, a bottom opposite lid, and side walls connecting the bottom and lid with one another to form a rectangular cylinder being open at its ends, with the holder holding the individual plugs in position in the axial direction by a form fit that is both simple to manufacture and easy to handle, wherein the plug housings have, on their jacket sides pointing toward the bottom of holder, a window-like recess, and where the bottom is provided with projections matching window-like recesses, and where the closed lid holds the plug housings in an active engagement of the window-like recess of plug housing and projection of the bottom.

5 Claims, 6 Drawing Sheets

MULTIPLE PLUG ARRANGEMENT WITH A PLURALITY OF INDIVIDUAL PLUGS

BACKGROUND OF THE INVENTION

1. Field of the Invention

The present invention generally relates to a multiple plug arrangement with a plurality of individual plugs that is both simple to manufacture and easy to handle. More particularly, plug arrangements are provided in particular for the connection of body electrodes to medical diagnostic and treatment equipment.

2. Background Description

Multiple plug arrangements are known, for example, from DE 30 12 174 C2 and DE 38 07 645 Al, having essentially rectangular plug housings and a holder that receives the plug housings arranged flush next to one another and with one another; the holder being closable on its top by a lid, and a bottom opposite the lid, and side walls connecting the bottom and lid with one another to form a rectangular cylinder and the cylinder is open at its ends, with the holder holding the individual plugs in position in the axial direction by a form fit. The individual plugs, which have essentially rectangular individual housings, are inserted or pushed into holders that are open on both sides in the lengthwise direction. By virtue of a positive connection between the holder and the correspondingly designed individual housings of the individual plugs, the individual plugs are locked in the holder in the lengthwise direction. In the embodiment disclosed in DE 38 07 645 A1, the individual plugs have grooves that are flush with one another, into which a foldable rib of the otherwise one piece holder engages to insure axial locking.

In the embodiment according to DE 30 12 174 C2, the holder is provided with specially shaped chambers, to whose shape the outside contour of the individual housings of the individual plugs is adapted. The holder has a foldable lid. When the lid is open, the individual plugs can be inserted from above into the chambers of the holder.

With the known plug arrangements, it is possible to connect the individual plugs to form a uniformly manipulatable plug arrangement, which can be inserted into a uniform matching piece. According to DE 38 07 645 A1, the holder has a tab pointing in the insertion direction, said tab cooperating with a matching recess in the matching piece to produce protection against twisting. The locking of the plug arrangement in the matching piece is accomplished by locking grooves which are formed on the contact pins of the plug arrangement and cooperate with matching locking elements in the matching piece.

The securing of the individual plugs in the known holders has disadvantages. The design of the holders with specially shaped chambers according to DE 30 12 174 C2 is expensive and results in an increased width of the entire arrangement, since the walls of the holder are still provided between the plug housings, by which walls the form fit perpendicular to the lengthwise direction of the individual plugs is produced.

The plug arrangement known from DE 38 07 645 A1 has the disadvantage that the individual plugs are pushed into the holder forming a closed rectangular cylinder from one open end, and must thus be carefully jointly positioned so that the foldable rib can engage in the otherwise closed top of the holder in the grooves of the individual plugs that are open at the top and are flush with one another.

Therefore, the known multiple plug arrangements of the types described have disadvantages of manufacture and/or handling.

SUMMARY OF THE INVENTION

It is therefore an object of the present invention to provide a multiple plug arrangement of the type involving a plurality of individual plugs with essentially rectangular plug housings and a holder that receives the plug housings arranged flush next to one another and with one another, where the holder is closable on its top by a lid, and a bottom is opposite the lid, and side walls connect the bottom and lid with one another to form a rectangular cylinder that is open at its ends, with the holder holding the individual plugs in position in the axial direction by a form fit, wherein the plug housings have, on their jacket side pointing toward the bottom of the holder, a window-like recess, where the bottom is provided with projections matching the window-like recesses, and where the closed lid holds the plug housing in an active engagement of the window-like recess of the plug housing and the projection of the bottom.

The present invention avoids the problems of prior multiple plug arrangements of the types described in the Background Description herein and provides a plug arrangement that is both simple to manufacture and easy to handle.

The multiple plug arrangement according to the invention has the advantage that the holder can be opened by the lid so that the individual plugs can be inserted from any direction, namely through the open ends, from above, or from all intermediate directions. In contrast to the known multiple plug arrangements, therefore, the handling advantage is obtained that a certain prescribed direction for insertion of the individual plugs into the holder does not exist. Furthermore, there is the advantage that each individual plug is brought individually into its correct position relative to the bottom, with the window-like recess being slid over the projection of the bottom. This automatically produces the alignment of the individual plugs in which they are flush with one another, with the plug housings of the individual plugs being able to abut one another directly with their jacket sides that are perpendicular to the bottom of the holder, so that a minimal structural width can be obtained. After all the individual plugs have been placed in the correct positions, the lid which is preferably articulated foldably on one side wall is closed, preferably by a locking connection on the opposite side wall.

It is especially advantageous for the present invention if a locking retention of the multiple plug arrangement on a matching piece, for example/of a medical device or a device cable, is accomplished not by latching contact pins of the individual plugs but by a tab of the holder that is arranged to project forward in the insertion direction of the individual plugs, with the tab having a locking means with which the holder is lockable in the matching piece by latching.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1A:
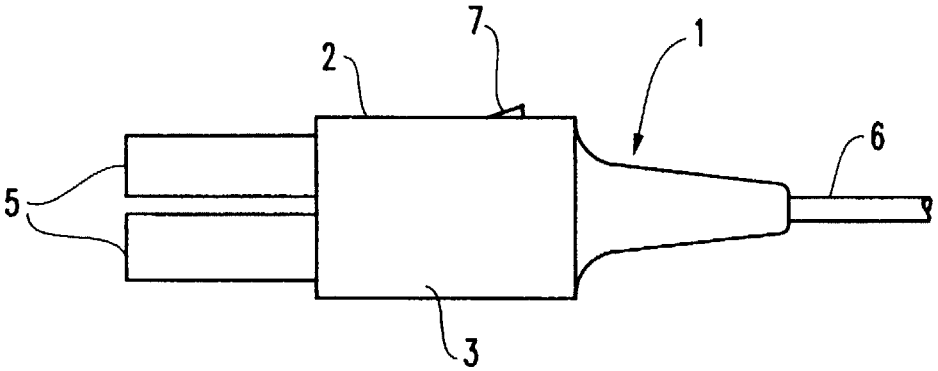
FIG. 1 shows three views a), b), and c) of an individual plug with two contact pins.

Referring now to the drawings, and more particularly to FIG. 1, there is shown an individual plug 1 with a rectangular housing 2 with large jacket surfaces 3 and small jacket surfaces 4 and two contact pins 5. Individual housing 2 is at the end of a cable 6 to which individual plug 1 is connected.

Figure 1B:
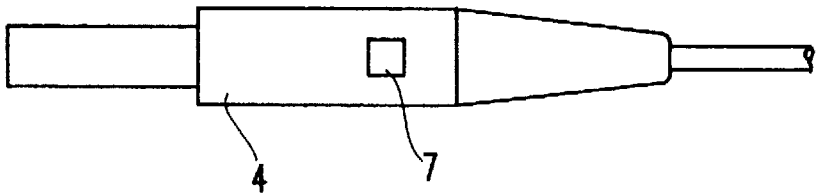

FIG. 1*a* shows a view of the individual plug on large jacket surface 3, and FIG. 1*b* shows a view of a small jacket surface 4. On small jacket surface 4 is a locking projection 7 which has a sawtooth-shaped contour in the form of a barb.

Figure 1C:
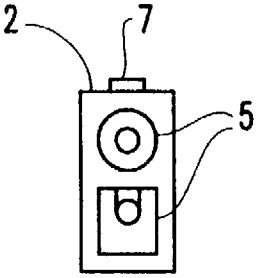

FIG. 1*c* is a view of the free end face of individual plug 1 and shows the shape of the two contact pins 5, one of which, according to AAMI standards, has a round cross section while the other has a square cross section.

FIG. 2 shows a plurality of views of a sleeve 8, which has a rectangular cross section and is open at one end face 9. At the opposite end face 10 the sleeve has through openings 11, whose shape matches the shape of contact pins 5. Sleeve 8 likewise consists of large jacket surfaces 12 and small jacket surfaces 13, while FIG. 2*a* shows a view of a large jacket surface and FIG. 2*b* shows a view of a small jacket surface. The small jacket surface 13, toward which the view in FIG. 2*b* is directed, has a window-like through opening 14 whose size matches the size of locking projection 7 of individual housing 2. Through opening 14 is sloped toward the outside and forms an outer window surface 15 that is larger than the inwardly directed window surface formed by through opening 14.

Figure 2D:
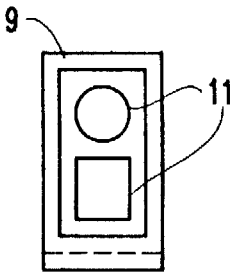
FIG. 2 shows four views a), b), c), and d) of a sleeve for the individual plug according to FIG. 1.
Figure 2A:
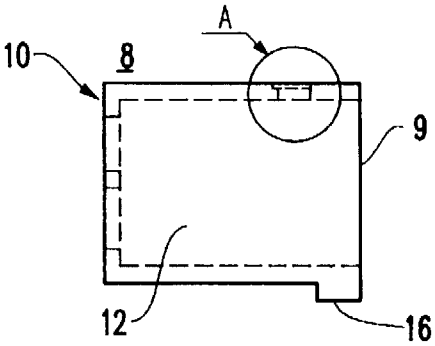
Figure 2B:
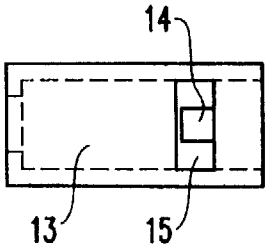
Figure 2C:
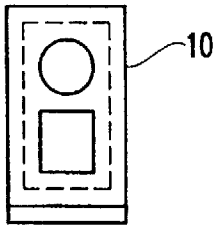

FIG. 2*a* and the views in FIG. 2*c* of end 10 and in FIG. 2*d* of end 9 show that sleeve 8, on a small jacket surface 13 that is not provided with through opening 14, has a projection 16 formed by a step toward end 9.

Figure 3:
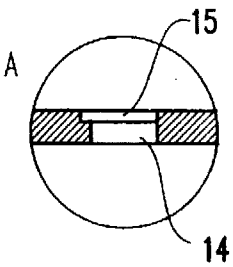
FIG. 3 shows an enlarged detail A of FIG. 2.

FIG. 3 shows in an enlarged and cut-away view that through opening 14 is sloped toward the outside and has a window area that is larger on the outside.

Figure 4A:
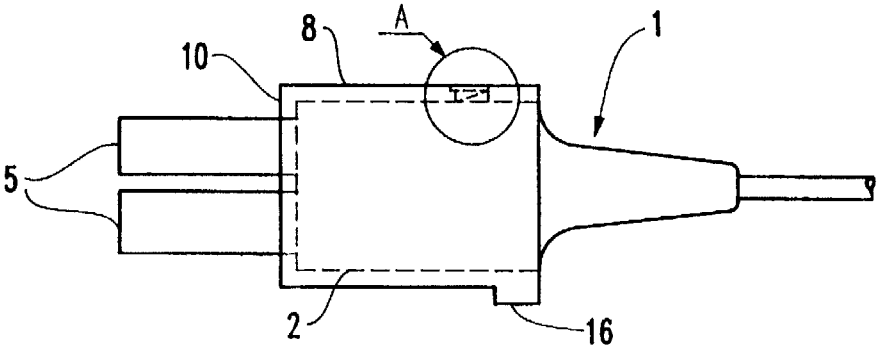
FIG. 4 shows three views a), b), and c) of the individual plug according to FIG. 1 with a locked sleeve according to FIG. 2.
Figure 4B:
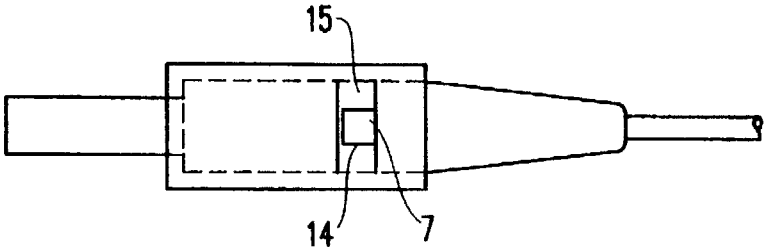
Figure 4C:
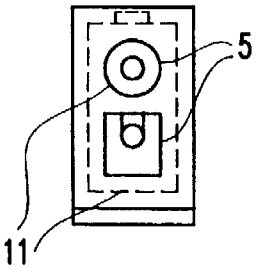

FIG. 4 shows three views of individual plug 1 with sleeve 8 snapped on. The position of contact pin 5 defines an insertion direction pointing toward the free end of contact 5 and shows that projection 16 of sleeve 8 is located at the rear in the insertion direction.

Figure 5:
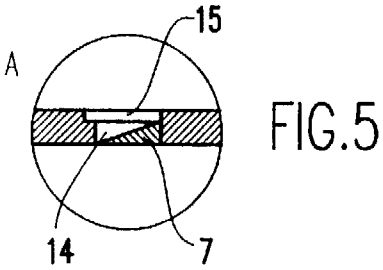
FIG. 5 shows an enlarged detail A of FIG. 4.

In particular, the enlarged detail shown in FIG. 5 shows that locking projection 7 of plug housing 2 extends only up to the step in through opening 14, in other words it does not project through into the area of enlarged window area 15. Locking projection 7 prevents inadvertent extraction of individual plug 1 from sleeve 8. Further insertion of individual plug 1 in sleeve 8 is prevented by end wall 10 provided with through openings 11 but is otherwise closed.

Figure 6:
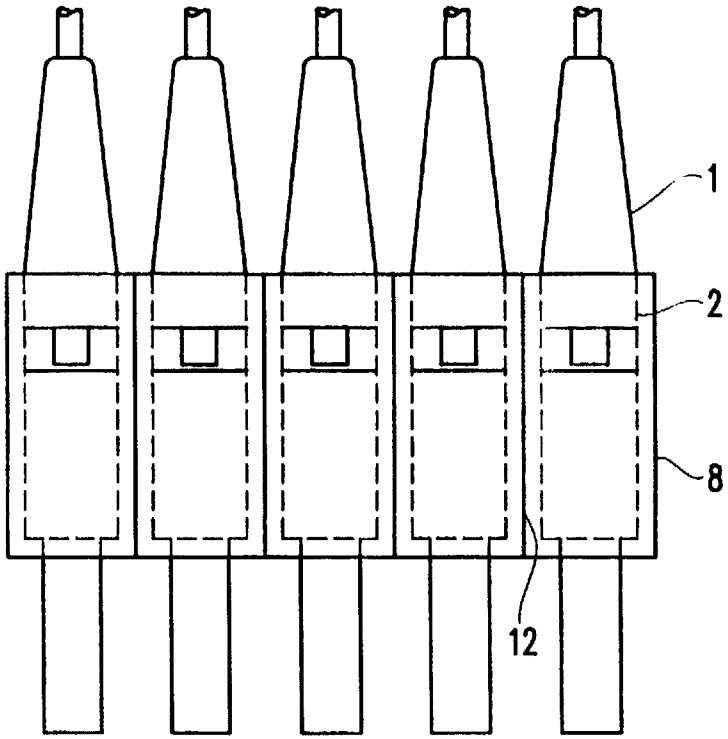
FIG. 6 shows an arrangement of five individual plugs positioned side by side.

FIG. 6 makes clear that in the embodiment shown, five individual plugs 1 with individual plug housings 2 can be assembled into a compact block, in which the individual housings with locked sleeves 8 abut one another by the large jacket surfaces 12 and are assembled flush with one another.

In the embodiment shown in FIG. 6, individual plug 1 can be received by the holder 17 shown in FIG. 7, and thus, become a uniformly manipulatable plug arrangement.

Holder 17 consists of a bottom 18, two side walls 19, and a lid rib 20 articulated foldably on one side wall 19, said rib being lockable by a locking nose 21 in a recess 22 in the other side wall 19 when the lid 20 is in the closed position. The holder is open at both end walls 23 and 24. The articulation of lid 20 on side wall 19 is made possible by a toothed design of the two parts and the insertion of a hinge pin 25.

Figure 7B:
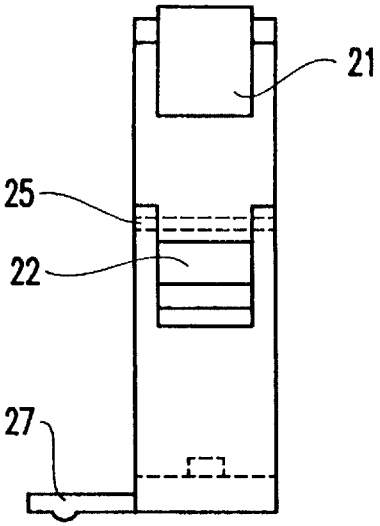
FIG. 7 shows four views a), b), c), and d) of a holder to receive the individual plugs in the arrangement according to FIG. 6.
Figure 7A:
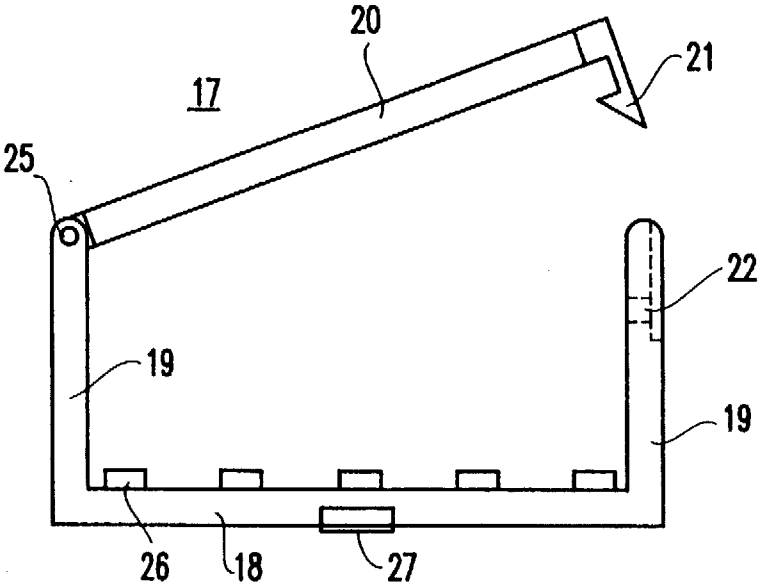
Figure 7D:
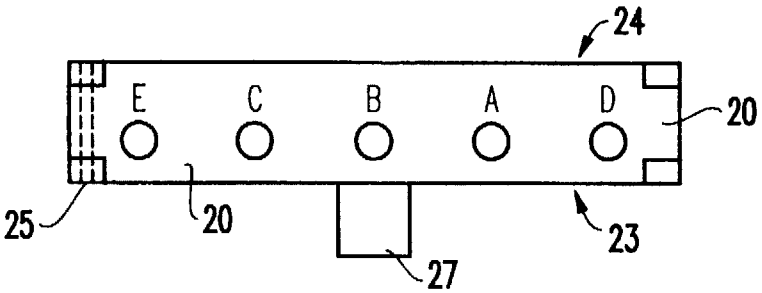
Figure 7C:
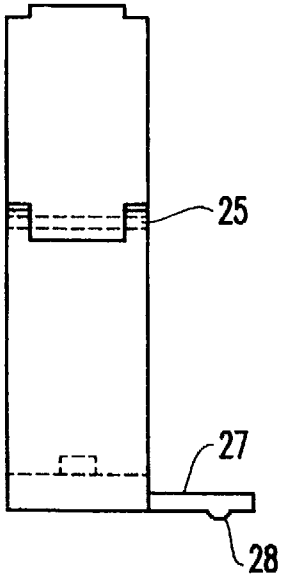
Figure 8B:
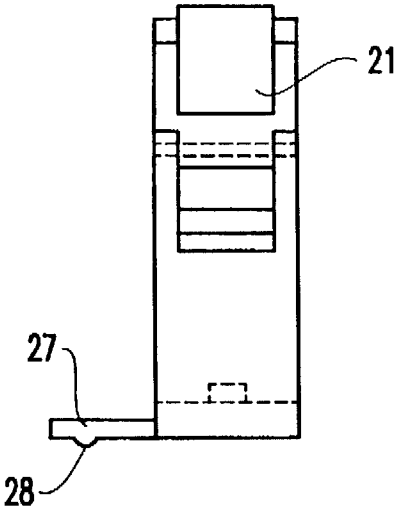
FIG. 8 shows four views a), b), c), and d) of a holder to receive three individual plugs positioned side by side.
Figure 8A:
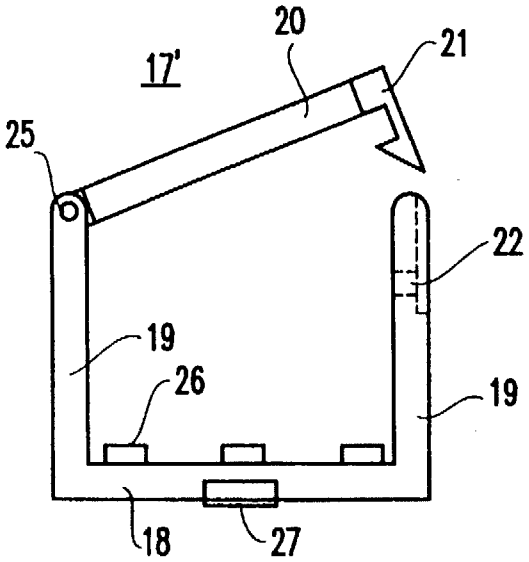
Figure 8D:
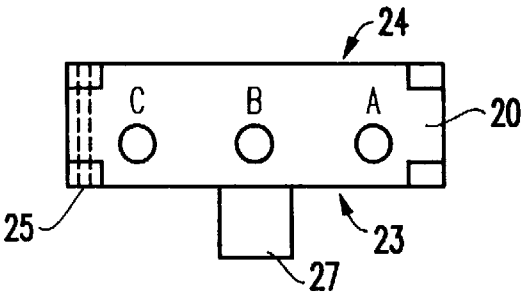
Figure 8C:
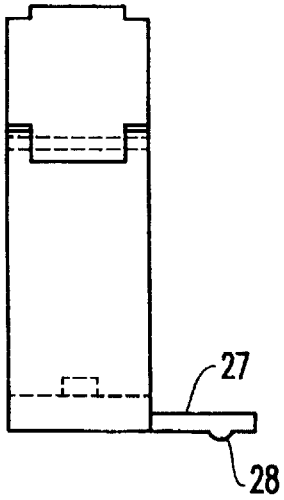

FIG. 7*a* shows a top view of the open end wall 23 with lid 20 in a partially opened position, FIG. 7*b* is a top view of side wall 19 provided with recess 22, and FIG. 7*c* is a top view of side wall 19 provided with hinge pin 25.

FIG. 7*d* is a top view of lid 20 which in the embodiment has markings in the form of letters and/or color identification for the transmission channels formed by individual plugs 1.

The axial immobilization of individual plugs 1 in holders 17 is performed by elevations 26 on bottom 18, whose size and position are selected so that they engage the large window opening 15 of through opening 14 in sleeve 8. Since the height of side walls 19 is adjusted to the height of the large jacket surface 12 of sleeve 8, sleeve 8 is thus held in place after lid 20 is closed.

On bottom 18, further in the forward insertion direction, in other words in front of end wall 23, a tab 27 is centrally mounted and projects, said tab having a locking bead 28 pointing downward. Tab 27 serves both for nonrotatable positioning of the plug arrangement and also for axial engagement of holder 17 and thus of all individual plugs 1 in holder 17, in the correspondingly designed (not shown) matching piece into which the plug arrangement is plugged.

The axial immobilization of the individual plugs in the matching piece is thus not effected by individual plugs 1 or their contact pins 5, but by the tabs 27 mounted on holder 17.

FIG. 8 shows views identical to those in FIG. 7 of a holder 17' which is provided to hold only three individual plugs 1, but otherwise is constructed completely identically to holder 17. FIG. 8*d* shows that holder 17' can also cooperate with a matching piece that is suitable for receiving a multiple plug arrangement with holder 17, in other words with five individual plugs 1. Then only channels A, B, C of the matching piece are occupied with holder 17'. The correct positioning of holder 17' in such a matching piece is ensured by tab 27.

Although the invention has been explained with reference to a preferred embodiment in which individual plugs (1) in each case are surrounded by sleeves (8), whereby uniform individual plugs (1) can be adapted to different matching pieces from different instrument manufacturers, and color coding is also not necessary by means of the individual plugs (1), but can be accomplished using the economical sleeves (8), the present invention can of course be achieved in the same fashion by the plug housings (2) of the individual plugs (1) themselves having the window-like recess (15).

While the invention has been described in terms of a single preferred embodiment, those skilled in the art will recognize that the invention can be practiced with modification within the spirit and scope of the appended claims.

What is claimed is:

1. A multiple plug arrangement, comprising:

a plurality of individual plugs with essentially rectangular plug housings, said plug housings having exterior sides;

a holder that receives said plug housings arranged side by side, said plug housings abut one another within said holder;

a lid, said holder being closable on a top thereof by said lid;

a bottom opposite said lid; and side walls connecting said bottom and said lid with one another to form a rectangular cylinder being open at its ends, with said holder holding said individual plugs in position in an axial direction by a form fit, wherein said plug housings have each, on that exterior side directed toward said bottom of said holder, a window-like recess, wherein said bottom is provided with projections matching said window-like recesses, and said lid, when closed, holds, said plug housings in an active engagement of said window-like recess of said plug housing and said projection of said bottom.

2. A multiple plug arrangement according to claim 1 wherein said lid is articulated foldably on a side wall.

3. A multiple plug arrangement according to claim 2 wherein said lid is lockably connectable with an opposite side wall.

4. A multiple plug arrangement according to claim 3 wherein said holder has a tab arranged at the front in an insertion direction of said individual plugs, with a locking means, by which said holder is lockably fixable in a matching piece.

5. A multiple plug arrangement for receiving and holding a plurality of rectangular shaped electrical plugs, comprising:

said plugs each having an exterior housing comprised of four side walls forming a rectangular shape, wherein a lower side wall of each plug housing having a recess capable of receiving a locking projection;

a holder having a bottom including a plurality of upstanding projections shaped to complementarily engage and interfit with said recesses on said lower side of said plug housings, said plug housings abutting one another, a first side wall, a second side wall spaced apart from and extending parallel to said first side wall, and a pivotable lid, wherein said first and second side walls perpendicularly connect with said bottom and said lid to form a rectangular cylinder shape, and said lid being pivotably connected to said first side wall via a hinge, and said lid articulated foldably on said second side wall with means provided for releasably locking said lid to said second side wall.

* * * * *